US005791220A

United States Patent [19]

Liao

[11] Patent Number: 5,791,220

[45] Date of Patent: Aug. 11, 1998

[54] CUTTING DEVICE OF PACKING APPARATUS

[75] Inventor: Benker P. C. Liao, Taipei, Taiwan

[73] Assignee: Benison & Co., Ltd., Taipei, Taiwan

[21] Appl. No.: 732,858

[22] Filed: Oct. 15, 1996

[30] Foreign Application Priority Data

Aug. 28, 1996 [TW] Taiwan ..... 85213221

[51] Int. Cl.[6] ..... B26D 5/00

[52] U.S. Cl. ..... 83/364; 83/356.3; 83/924; 83/303

[58] Field of Search ..... 83/54, 222, 303, 83/370, 355, 356.3, 364, 367, 591, 924, 946

[56] References Cited

U.S. PATENT DOCUMENTS

| | | | |
|---|---|---|---|
| 3,114,282 | 12/1963 | Reifenhauser et al. | 83/370 |
| 4,488,467 | 12/1984 | Hegler et al. | 83/303 |
| 4,703,765 | 11/1987 | Paules et al. | 83/355 |
| 5,531,858 | 7/1996 | Hong | 83/54 |

*Primary Examiner*—Maurina T. Rachuba
*Attorney, Agent, or Firm*—Rosenberg, Klein & Bilker

[57] ABSTRACT

A cutting device of packing apparatus includes at least three cutting blades arranged around the packing material expanding cylinder in a substantially equally-spaced manner. The cutting blades are rotatable about their own rotational axes in a synchronous manner for cutting off the continuous packing material along a circumferential slit formed on the cylinder. This simplifies the overall structure by eliminating a mechanism to move the blades around the cylinder. By using a number of blades rotatable in synchronization with each other, the time period for a single blade in contact engagement with the packing material to be cut off is substantially reduced and the efficiency of the cutting operation is enhanced. Due to the enhanced efficiency, the delay of time in the alternation of the feeding operation and cutting operation is lowered down. Further, the cutting blades are rotated in a continuous, non-intermittent manner and the rotation speed thereof is controlled to allow the blades to contact the packing material at an interval that is sufficient to forward the packing material to the desired length to be cut off.

1 Claim, 5 Drawing Sheets

CUTTING DEVICE OF PACKING APPARATUS

FIELD OF THE INVENTION

The present invention relates to a packing apparatus which applies a packing material supplied in a continuous fashion to a product and cut at a desired length corresponding to the product with a built-in cutting device so as to properly pack a product and in particular to an improvement of the cutting device of the packing apparatus.

BACKGROUND OF THE INVENTION

Packing apparatus which receives a continuous supply of packing material, such as shrink film, and cut the continuous packing material at a desired length to fit over and pack products that are transported by means of, for example a conveyor, to move through the packing apparatus, is known. The packing apparatus is devised with a cutter to cut off the continuous packing material at a desired length which corresponding to the product to be packed.

In FIGS. 1–3, a general configuration of the packing apparatus of such a kind is illustrated. It should be noted that the general configuration of the packing apparatus is not a feature of the present invention so that the description of the apparatus itself will also be applicable to the cutter of the instant invention.

As shown in FIG. 1, a packing apparatus of this kind comprises a frame 10 on which a roller 11 supporting a roll of a continuous packing material 12 is mounted. The packing material 12 comprises two sheets or films overlapping and connected along two opposite longitudinal sides to each other so as to form a tubular configuration when expanded. The continuous packing material 12 is comprised of a plurality of identical sections connected to each other in the longitudinal direction, each section having patterns or product descriptions printed thereon with a transparent strip 15 to spacing the printed pattern from that of the next section, see FIG. 3.

The packing apparatus further comprises a feeding mechanism 30 which supplies the packing material 12 from the roller 11 to an expanding cylinder 20 where the packing material 12 is expanded and cut along the transparent strip 15 by means of a cutter. The cut length of the packing material 12 is then fit onto products 17 transported by means of a conveyor 16 through under the expanding cylinder 20.

The feeding mechanism 30 may comprise idle rollers 13 to escort the continuous packing material 12 from the roller 11 to the cylinder 20, as is best shown in FIG. 3. A sensor 14 is provided along the path of the continuous packing material 12 to detect the transparent strips 15 of the packing material 12 for controlling, in cooperation with known electronic control device not shown in the drawings, the length of the cut sections of the packing material.

As shown in FIG. 2A, the expanding cylinder 20 comprises an elongated cylindrical body having a blade 21 mounted on a top end thereof. The top end of the cylinder 20 is also provided with two converging inclined faces which cooperate with the blade 21 to provide a gradually expanding and downward diverging configuration for expanding the continuous packing material 12, which is allowed to slide over the cylinder 20, into a tubular form, as shown in FIG. 3. A circumferential slit 23 is formed on the cylinder 20, corresponding in position to the cutter. The cutter is controlled to move along the slit 23 and make a full turn about the cylinder 20 so as to cut a section off the continuous packing material 12.

The cylinder 20 comprises two pairs of feeding/support rollers 22 diametrically opposite each other and located above the slit 23. The feeding/support rollers 22 are rotatably supported on the cylinder 20 and having a portion thereof protruding out of the cylinder 20. The cylinder 20 further comprises two dispensing rollers 24 which are also diametrically opposite to each other and located below the slit 23 and rotatably supported on the cylinder 20. The dispensing rollers 24 also have a portion protruding out of the cylinder 20.

As shown in FIG. 4, the feeding mechanism 30 comprises two parallel and spaced shafts 35 which are driven by a motor 31 through gears 32, belts 33 and couplings 34 to be rotatably in synchronization with each other. The gears 32, belts 33 and couplings 34 are all well known mechanical elements and the arrangement thereof is also known to those having ordinary skills so that no further detail will be needed. Preferably, a hand wheel 38 with a screw extending therefrom and drivingly engaging the shafts 35 is provided to adjust the spacing between the two shafts 35.

The two shafts 35 each drive a roller 36 or 37. The rollers 36 and 37 are arranged to respectively rollingly engage the feeding/support roller pairs 22 for "floatingly" support the cylinder 20. Due to the rolling engagement between the rollers 22 and the rollers 36 and 37, the rotation of the rollers 36 and 37 does not cause any movement of the cylinder 20 and only the rollers 22 are driven to rotate relative to the cylinder 20. In the practical operation, the expanded tubular packing material 12 is interposed between the rollers 22 and the rollers 36 and 37 so that when the rollers 36 and 37 are driven by the motor 31, the packing material 12 is forced to move along the cylinder 20.

A dispensing mechanism 40 is provided to drive the cut sections of the material 12 onto the products 17 to be packed. The dispensing mechanism 40 comprises two rollers 43 (only one visible in FIGS. 2 and 3) driven by a motor 40 through two parallel and spaced shafts 42. The two rollers 42 are in rolling contact engagement with the dispensing rollers 24 and similarly, the cut section of the packing material 12 is interposed between the dispensing rollers 24 and the rollers 43 so that when the rollers 43 are driven by the motor 41, the cut section of the packing material 12 is moved downward (in the view of FIG. 3) to be dispensed onto the product 17.

The dispensing mechanism 40 comprises a hand wheel 44, which cooperates with a screw (not shown) extending therefrom and drivingly engaging the shafts 42 serves to adjust the spacing between the shafts 42. A further hand wheel 45 is provided to adjust the location of the dispensing mechanism 40 relative to the cylinder 20 for modifying the length of the cut sections.

In the conventional design of the packing material cutter devised in the packing apparatus, the cutter is provided with a single sharpened blade to be receivable within the slit 23 so that when the cutter is made to rotate a full turn around the cylinder 20, the blade cut completely through the packing material 12. A disadvantage of this conventional design it that it has complicated mechanism to operate the cutter. A need of large space is inevitable for this conventional design. Also, the cost is high.

An alternative conventional design of the cutter comprises a scissors-like mechanism operated by a power cylinder, such as pneumatic cylinder, which cuts off the packing material 12 at a location below the cylinder 20. An obvious disadvantage is the need of for example pneumatic power source, such as an air compressor. This is complicated and high cost.

Further, a common disadvantage for the above two conventional designs of the cutter is that it needs to pause the feeding of the packing material in performing the cutting operation. The feeding operation does not once resumes the cutting operation is completed. On the other hand, the cutting mechanism has to be completely stopped or turned off when the packing material is being fed. Thus, the overall delay in time of the conventional designs is quite substantial. In addition, frequently alternation of activation and de-activation of the cutter may increase potential damages to the device and eventually shortens the service life of the device.

It is therefore desirable to provide an improved cutter for use in a packing apparatus of the kind discussed above which overcomes the drawbacks found in the prior art designs.

OBJECTS OF THE INVENTION

A primary object of the present invention is to provide a cutting device for use in a packing apparatus which comprises a plurality of cutting blades operated in a synchronous manner to cut off the continuous packing material so as to substantially reduce the time of contact engagement between the cutting blades and the packing material for enhancing the efficiency of cutting operation.

Another object of the present invention is to provide a cutting device for use in a packing apparatus which is capable to complete the cutting operation in a shorter time so as to reduce the delay in time between the alternation between cutting operation and the feeding operation.

A further object of the present invention is to provide a cutting device for use in a packing apparatus which is simple in structure and cheap in cost.

To achieve the above objects, there is provided a cutting device of packing apparatus, comprising at least three cutting blades arranged around the packing material expanding cylinder in a substantially equally-spaced manner. The cutting blades are rotatable about their own rotational axes in a synchronous manner for cutting off the continuous packing material along a circumferential slit formed on the cylinder. This simplifies the overall structure by eliminating a mechanism to move the blades around the cylinder. By using a number of blades rotatable in synchronization with each other, the time period for a single blade in contact engagement with the packing material to be cut off is substantially reduced and the efficiency of the cutting operation is enhanced. Due to the enhanced efficiency, the delay of time in the alternation of the feeding operation and cutting operation is lowered down. Further, the cutting blades are rotated in a continuous, non-intermittent manner and the rotation speed thereof is controlled to allow the blades to contact the packing material at an interval that is sufficient to forward the packing material to the desired length to be cut off.

The features and advantages of the present invention will be readily understood from the following description of preferred embodiments with reference to the attached drawings, wherein:

DETAILED DESCRIPTION OF THE PREFERRED EMBODIMENTS

Figure 1:
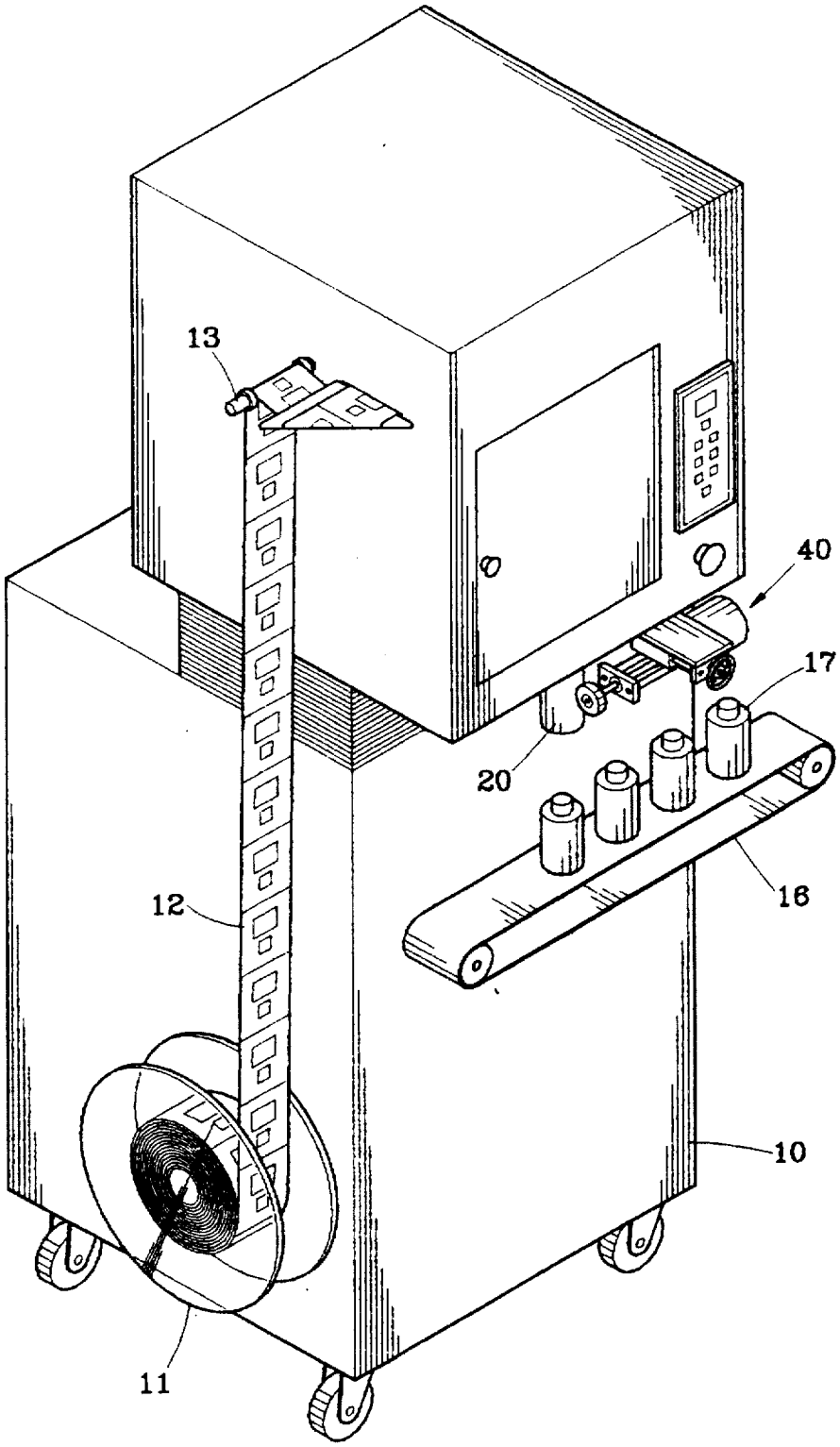
FIG. 1 (PRIOR ART)
FIG. 1 is a perspective view showing a packing apparatus within which a cutting device in accordance with the present invention is mounted.
Figure 2A:
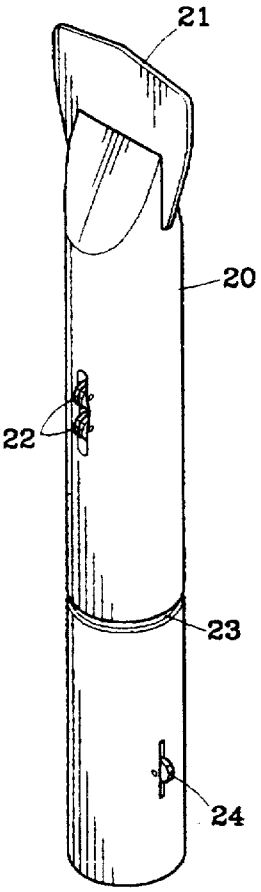
FIG.2A (PRIOR ART)
FIG. 2A shows a perspective view of an expanding cylinder adapted in the packing apparatus of FIG. 1 to expand the packing material into a tubular form for fitting over products to be packed.
Figure 2:
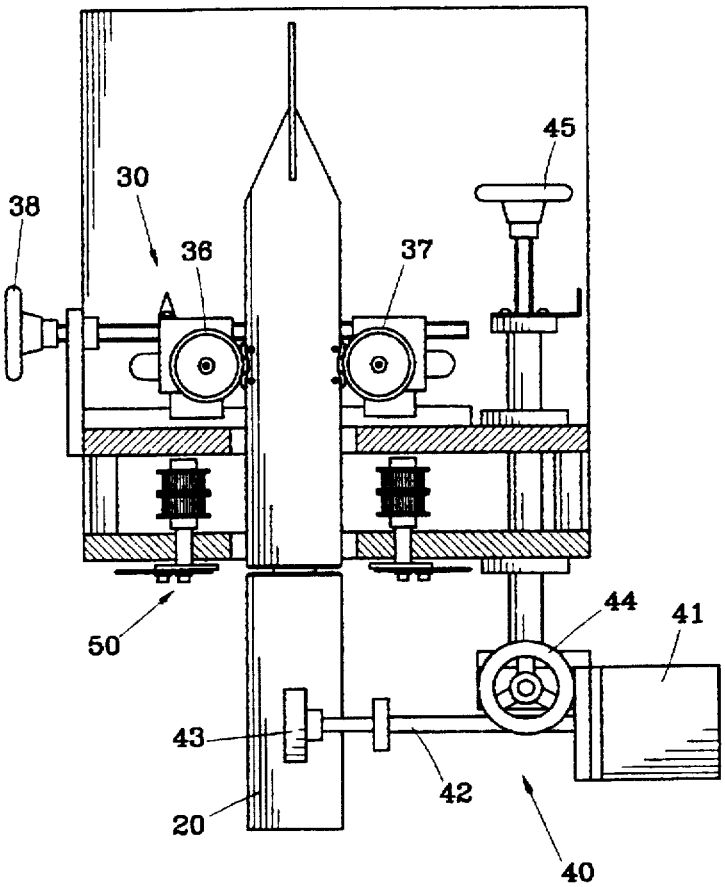
FIG. 2 is a schematic cross-sectional view showing the packing material feeding mechanism and the packing material dispensing mechanism of the packing apparatus of FIG. 1.
Figure 3:
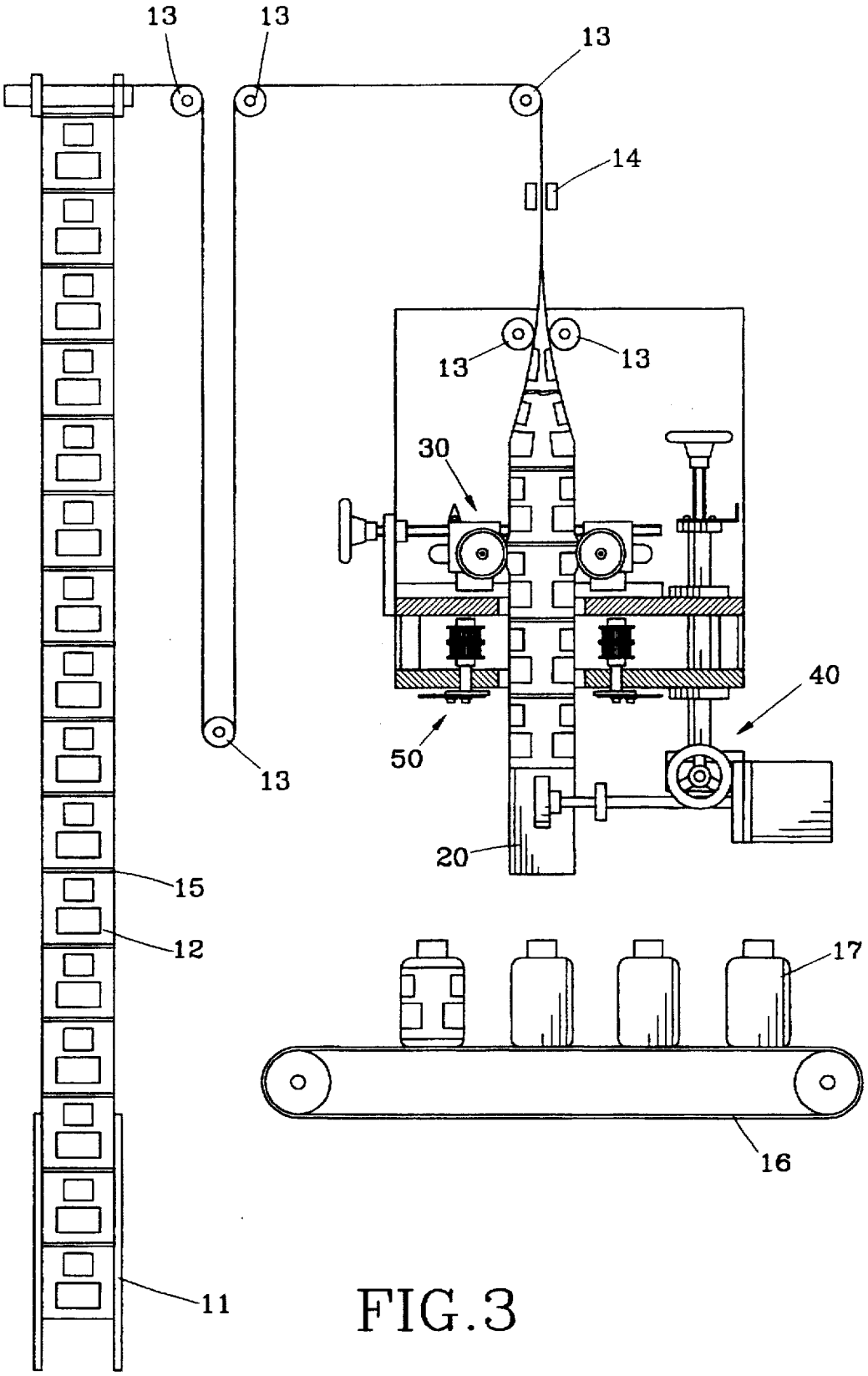
FIG. 3 is a schematic view, similar to FIG. 2, but showing the packing material fed through the packing apparatus and fitting over the product to be packed.
Figure 4:
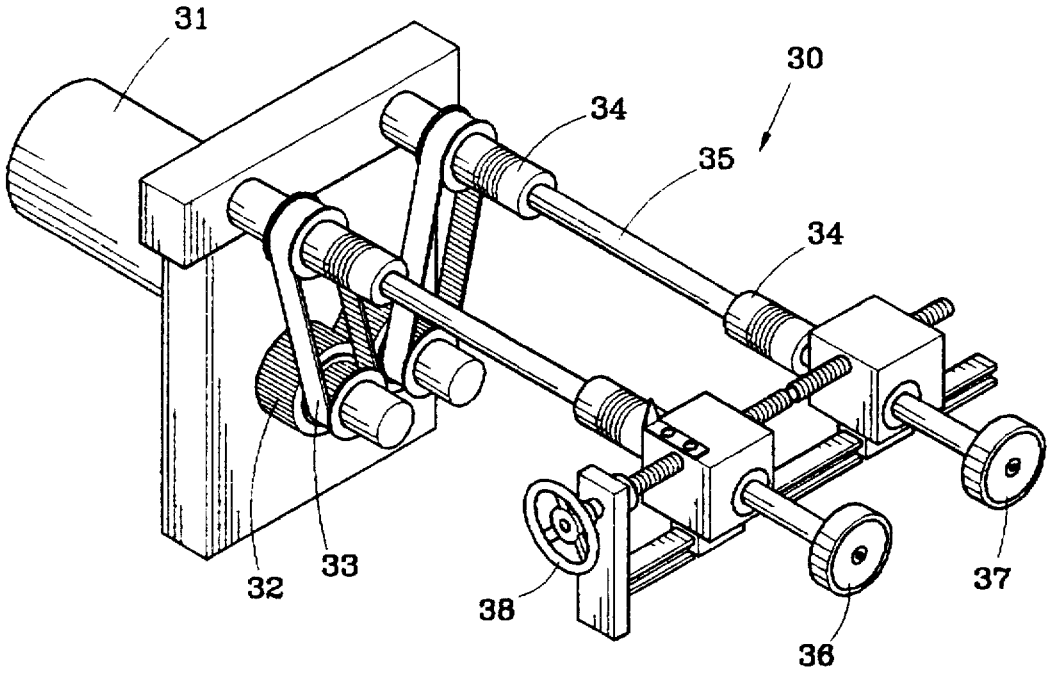
FIG.4 (PRIOR ART)
FIG. 4 is a perspective view showing the feeding mechanism which comprises two rollers to rollingly engages rollers provided on the expanding cylinder for floatingly supporting the expanding cylinder.
Figure 5:
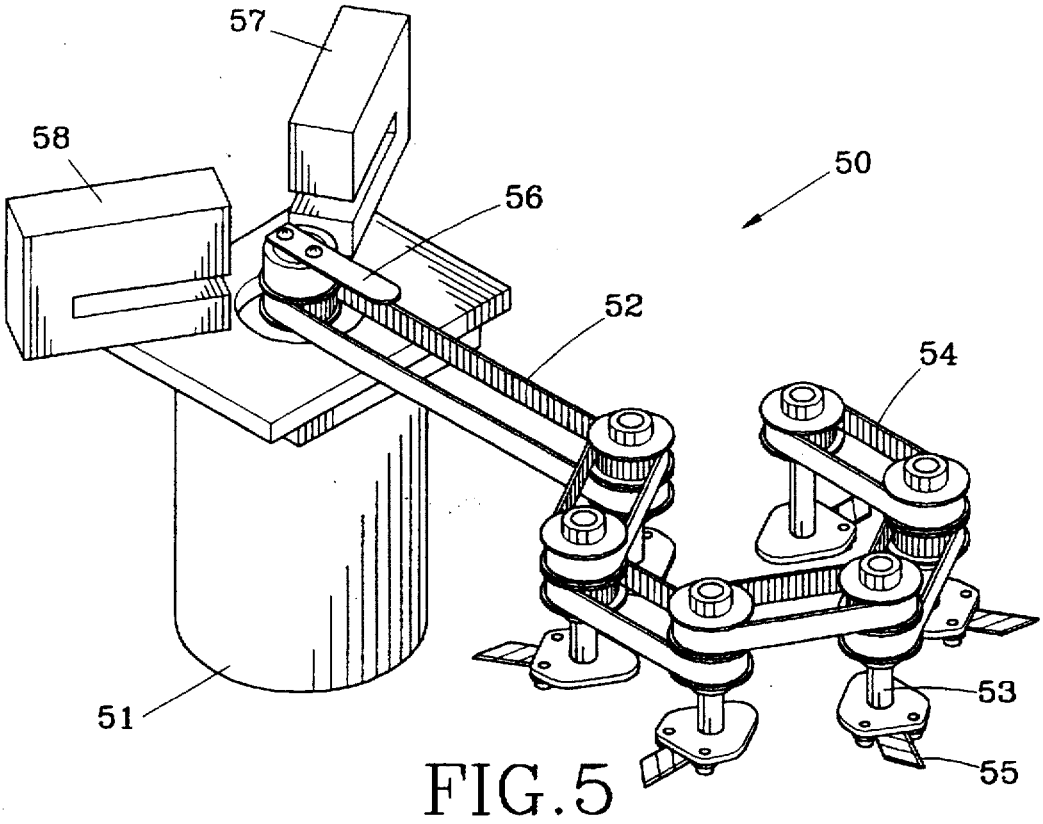
FIG. 5 is a perspective view showing the cutting device in accordance with the present invention to be incorporated in the packing apparatus of FIG. 1.

With reference to the drawings and in particular to FIGS. 2, 3 and 5, wherein a cutting device for use in a packing apparatus constructed in accordance with the present invention is shown, the packing apparatus which is more clearly shown in FIGS. 1–3 comprises a machine frame 10 on which a roller 11 is provided to receive a roll of continuous packing material 12 wrapped thereon. In the embodiment illustrated, the packing material 12 comprises two elongated films overlapping and connected together along two longitudinal sides thereof to each other so that when expanded, a tubular configuration is formed. The continuous packing material 12 may be divided into a number of longitudinal sections each having patterns or product descriptions printed thereon. Transparent strips 15 are provided on the packing material 12 to separate the sections.

The packing material 12 is supplied by a feeding mechanism 30 driven by a motor 31 to an expanding cylinder 20 (best shown in FIG. 2A) having a receiving blade 21 to expand the packing material 12. The expanded packing material 12 is allowed to slide over the expanding cylinder 20 by the feeding mechanism 30. A cutting device, constructed in accordance with the present invention and generally designated at 50, is provided to cut off the expanded packing material 12 to have a desired length corresponding to the printed sections discussed above. A dispensing mechanism 40 driven by a motor 41 is provided to move the cut sections of the packing material 12 toward products 17 to be packed.

As shown in FIG. 5, the cutting device 50 comprises a plurality of cutting blades 55 which are driven by rotatable axles 53 to rotate about the axles 53. The axles 53 are arranged in a substantially angularly equally spaced manner to surround the cylinder 20 on which the packing material 12 is fit. The axles 53 are interconnected together by means of, for example belts, such as timing belts 54, to be rotatable in synchronization with each other.

Figure 6:
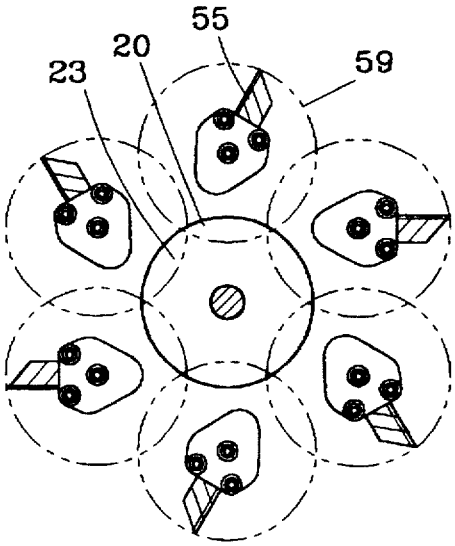
FIG. 6 is a plan viewshowing the arrangement of the cutting blades in accordance with a first embodiment of the present invention.

Preferably, the cutting blades 55 are arranged to be substantially normal to the axles 53 with a tip thereof facing outward so that when the cutting blades 55 are rotated by and about the axles 53, the tips thereof move along circular traces 59, see FIG. 6.

The cutting device 50 comprises a motor 51 which is connected to the interconnected axles 53 via a belt 52, which may also be a timing belt, so that the operation of the motor 51 drives the cutting blades 55 to rotate about their own axles 53 in a synchronous manner.

The spatial relationship between the cutting blades 55 and the expanding cylinder 20 is that the rotation of the axles 53 which form the circular traces 59 brings each of the cutting blades 55 to move through a portion of a circumferential slit 23 formed on the cylinder 20. Namely, the circular trances 59 of the cutting blades 55 are arranged to intersect the cylinder 20 in such a manner that the movements of the cutting blades 55 through the slit 23 together are sufficient to cut off the packing material 12 fit on the cylinder 20. In other words, the circumference of the cylinder 20 defined by the slit 23 is completely shared by the circular traces 59 of all the cutting blades 55.

In the embodiment illustrated, there are six such cutting blades 55. A plan view of the arrangement of the six cutting blades 55 is shown in FIG. 6 wherein the circular traces 59 of the tips of the cutting blades 55 are shown intersecting the circumference of the cylinder 20. It can be observed from the drawings that the six circular traces 59 together completely share the circumference of the cylinder 20. This indicates that the packing material 12 that surrounds the circumference of the cylinder 20 can be cut off effectively.

Figure 7:
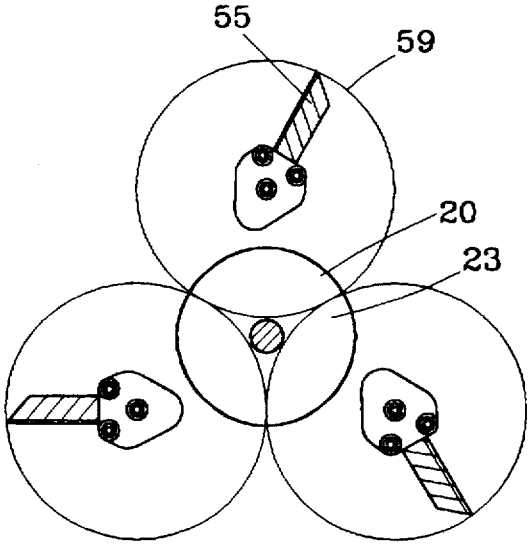
FIG. 7 is a plan viewshowing the arrangement of the cutting blades in accordance with a second embodiment of the present invention.

The cutting operation may also be performed with less cutting blades, such as three cutting blades shown in FIG. 7. It is suggested that the number of the cutting blades should be at least three, otherwise the circumference of the cylinder 30 may not be completely covered by the circular traces 59 defined by the cutting blades 55. However, the more the number of the cutting blades 55, the shorter the time that the cutting blades 55 in engagement with the slit 23 and thus the higher the efficiency of the cutting operation.

The cutting device 50 further comprises detecting means which controls the feeding and dispensing operations driven by the motors 31 and 41. The detecting means comprises a first sensor 57 and a second sensor 58 which are spaced from each other at a pre-determined distance and a triggering plate 56. In the embodiment, each of the sensors 57 and 58 has a gap which generates a signal once an article passes therethrough. The triggering plate 56 has an end coupled to the motor 51 to be rotated thereby for driving an opposite remote end to pass through the gaps of the sensors 57 and 58.

In the preferred arrangement of the present invention, the rotation of the triggering plate 56 is in a pre-determined time relationship with that of the cutting blades 55 so that when the triggering plate 56 passes through the first sensor 57 when a signal is generated to pause the feeding operation of the packing material and the packing material 12 is held standstill on the cylinder 12, the cutting blades 55 are approaching and getting into the slit 23 of the cylinder 20 to cut off the packing material 12. The rotation of the cutting blades 55 moves them to completely get through the slit 23 and at the same time the triggering plate 56 is moved to the second sensor 58. Once the cutting operation is completed and the triggering plate 56 just travels through the predetermined distance from the first sensor 57 to the second sensor 58 and passes the second sensor 58, the second sensor 58 sends out a signal to resume the feeding operation of the packing material 12. The time that is needed for the triggering plate 56 to move from the second sensor 58 to the first sensor 57 to initiate the next cutting operation is equal to that is needed to feed the packing material 12 with the desired length. With such an arrangement, the motor 51 of the cutting device 50 is allowed to continuously operate without any intermittent shutdown.

The above description is made with respect to the preferred embodiments of the present invention and for those skilled in the art, it is possible to made a variety of modifications and changes to the above-described embodiments without departing from the scope and spirit of the present invention. All these modifications and changes should be considered within the scope of the present invention as defined in the appended claims.

What is claimed is:

1. A cutting device for use in a packing apparatus where the packing apparatus includes a feeding mechanism for passing a supply of continuous packing material over an expanding cylinder, the expanding cylinder expanding the packing material into a tubular form for passage over a product, the expanded tubular packing material being cut to a predetermined length by said cutting device, said cutting device comprising:

a continuously rotating motor;

at least three rotatable axles mechanically interconnected for synchronized rotation one with respect to another, said at least one of said axles being mechanically interconnected to said motor for continuously rotatably driving said at least three axles in synchronization therewith;

at least three cutting blades respectively coupled to said at least three axles for rotation therewith, each of said cutting blades being moved along a circular trace that intersects a circumferential portion of the expanded tubular packing material, said circumferential portion of the expanded tubular packing material cut said at least three cutting blades defining an entire circumference of said expanded tubular packing material to completely sever the predetermined length thereof from the continuous supply;

a triggering plate coupled to said motor for rotation therewith; and, a pair of sensors positioned to detect passage of said triggering plate and coupled to the feeding mechanism for control thereof, a first of said pair of sensors signaling the feeding mechanism to pause movement of the packing material responsive to detection of said triggering plate in proximity thereto and a second of said pair of sensors signaling the feeding mechanism to resume movement of the packing material responsive to detection of said triggering plate in proximity thereto, said first and second sensors being spaced one relative to said other and each of said cutting blades being positioned on a respective axle for severing said predetermined length of said expanded tubular packing material during a first time interval defined by said triggering plate being displaced from said first sensor to said second sensor and said packing material being displaced a distance equal to said predetermined length during a second time interval defined by said triggering plate being displaced from said second sensor to said first sensor.

* * * * *